United States Patent [19]

Weber et al.

[11] Patent Number: 4,564,342

[45] Date of Patent: Jan. 14, 1986

[54] PERISTALTICALLY OPERATING ROLLER PUMP AND PUMP ROTOR THEREFOR

[75] Inventors: Wolfram Weber, Spiesen-Elversberg; Hans-Jürgen Neumann; Artur Meisberger, both of St. Wendel; Bernd Mathieu, Spiesen-Elversberg, all of Fed. Rep. of Germany

[73] Assignee: Fresenius AG, Fed. Rep. of Germany

[21] Appl. No.: 633,804

[22] Filed: Jul. 24, 1984

[30] Foreign Application Priority Data

Jul. 25, 1983 [DE] Fed. Rep. of Germany ..... 3326786

[51] Int. Cl.[4] ..... F04B 43/12; F04B 45/08

[52] U.S. Cl. ..... 417/477

[58] Field of Search ..... 417/477, 476, 475

[56] References Cited

U.S. PATENT DOCUMENTS 2,909,125 10/1959 Daniels ..... 417/477

FOREIGN PATENT DOCUMENTS 1807979 7/1969 Fed. Rep. of Germany .

2556906 1/1976 Fed. Rep. of Germany .

3237014 5/1983 Fed. Rep. of Germany .

2051253 1/1981 United Kingdom ..... 417/477

2076068 11/1981 United Kingdom ..... 417/477

126017 4/1959 U.S.S.R. ..... 417/477

*Primary Examiner*—Richard E. Gluck

*Attorney, Agent, or Firm*—Pravel, Gambrell, Hewitt & Kimball

[57] ABSTRACT

A peristaltically operating roller pump, in particular a hose pump for medical technology, comprises a pump bed (25) whose bearing wall (28) in the exit region (31) has a curvature which is in the same sense as the circular path (33*a*) of a roller (33) mounted on a pump rotor (1) and which has a radius of curvature which is constant with respect to the circular path (33*a*) or gradually increases in the direction of rotation of the roller (33). The pump rotor (1) comprises a gear connection so that a constrained radial movement of a roller is converted to a corresponding follow-up movement of the other rollers or roller. By this combination of pump bed and pump rotor pressure peaks and fluctuations of the flow rate are effectively prevented.

11 Claims, 8 Drawing Figures

V/Z

Y AXIS
t1
t2
t3
t4 ≙ t1
t
X AXIS h
Y AXIS
0
A
B
C
D
E
t
X AXIS

PERISTALTICALLY OPERATING ROLLER PUMP AND PUMP ROTOR THEREFOR

The invention relates to a peristaltically operating roller pump, in particular a hose pump or squeezed tube pump for medical technology.

In its basic concept a roller pump comprises a stator and a rotor. The stator is formed on the pump housing and comprises a depression against the vertical continously extending bearing wall of which a pump hose bears. The area at which the pump hose bears on the bearing wall forms the pump bed which has the contour of a circular segment. Through the centre point of this circular segment extends the axis of rotation of a rotor which comprises rollers rotatably mounted at its free ends. On rotation of the rotor in the operating direction the rollers come into contact with the pump hose which bears on the circular contour of the pump bed and on further rotation compress said hose to such an extent that it is sealed in fluid-tight manner. On further rolling of the rollers on the pump hose the pumped medium disposed in said hose is further conveyed. In the majority of cases such a roller pump comprises two rollers which are arranged on the rotor in such a manner that the connecting line through their axes of rotation on the rotor extends through the axis of rotation of said rotor.

At present, two different construction principles for mounting the rollers on the rotor are known. In one case, the roller carriers which form the connection between the rollers and the drive portion of the rotor are rigidly connected to the latter so that the rollers cannot execute any movement relative to the rotor other than the rotation about their own axes of rotation to roll on the pump hose. In the other case the roller carriers are mounted radially movably on the rotor and pressed radially outwardly by spring force. Thus, in addition to the rotation about their own axes the rollers can execute a radial movement with respect to the rotor.

Both these construction principles have advantages and disadvantages:

The resilient mounting of the rollers on the rotor as known for example from DE-OS No. 3,237,014 permits use of pump hoses of different wall thickness because due to the resilient mounting the rollers automatically adapt themselves to the optimum rolling radius. This guarantees that both thick and thin-walled pump hoses are always reliably occluded without being too greatly stressed. However, in roller pumps of the type according to DE-OS No. 3,237,014 the problem of pulsation occurs, the magnitude of the delivery pressure not being constant but sometimes exhibiting very considerable fluctuations in the positive and negative direction. These fluctuations, which occur as peaks, usually make it necessary to employ a pressure compensating means.

The physical and technical effect which produces these pressure peaks can be explained as follows:

The pump bed is only circular over a predetermined region; in the case for example of two rollers on the rotor the pump bed represents an arc of 180° at the two ends of which the pump bed continues linear tangentially. This continuation of the bed contour is the exit from the pump bed. Up to the point at which the arc merges into the tangent of the exit the rollers thus move on rotation of the rotor on a circular path concentric to the drive axis with constant rolling speed. From the aforementioned position onwards the roller, still pressed outwardly by the spring, follows the tangent, moving forwardly in the direction of rotation relatively to the rotor. Thus, the radius between the roller axis and the rotor axis of rotation increases. The roller follows the tangential path until it has reached its outer stop position. Since the speed of rotation of the rotor still remains constant but the distance of the roller axis from the rotor axis of rotation increases, the roller is accelerated, i.e. the rolling speed on the pump hose is increased, also increasing the flow rate of the pumped medium in the pump hose and thus producing a positive pressure surge.

At the same time, the pump hose is stretched or displaced by the roller so that when the roller is lifted off the hose springs back by a predetermined amount. This then leads to a negative pressure surge.

When using a rotor in which the rollers are fixedly mounted at least the positive pressure surge described above cannot occur because the rollers cannot execute and motion relative to the rotor. However, this pump type has the disadvantage that only a pump hose with a given wall thickness can be used because thick-wall hoses would be squashed and thin-wall hoses no longer reliably occluded, which would make proper function of the pump uncertain.

DE-OS No. 1,807,979 discloses a peristaltically operating roller pump in which a constructional facility is provided for varying the radial distance of the roller axes of rotation to the rotor axis of rotation in order to set the roller pump to various hose diameters. For this purpose, a gear connection is provided in the form of a cam disk which engages two roller carriers in such a manner that it forms an adjustable stop for the radial spring-loaded outward movement of the roller supports together with the rollers rotatably mounted thereon.

However, for the optimum radial adjustment of the rollers it must be ensured that under the spring force they properly occlude the hose. Such an ideal radial spacing of the rollers from the axis of rotation of the rotor is however ensured only in a single exactly defined position of the cam disk. If the cam disk is not rotated enough the hose will not be reliably occluded and if the cam disk is rotated beyond the ideal point although the rollers are pressed by the pressure springs radially outwardly and properly occlude the pump hose on leaving the semicircular path of the pump bed the rollers are able to move radially further outwardly until the roller carriers again come into engagement with the cam disk. Due to the radial increased spacing between the roller axis of rotation and the rotor axis of rotation the already mentioned problems of pressure fluctuations again arise.

A further procedure for reducing the pulsation is the use of three or more rollers. Such an arrangement is known for example from U.S. Pat. No. 2,965,041. This step however does not adequetly reduce the pulsation and has the further serious disadvantage of increasing the hemolysis rate. The hemolysis, that is the destruction of the red blood cells, for a given pumping rate and the same pump hose, is approximately proportional to the number of rollers.

It is further known from U.S. Pat. No. 2,965,041 to form the exit region of the pump bed in such a manner that the rollers on rotation of the pump rotor slowly release the pump hose. However, in the arrangement chosen according to U.S. Pat. No. 2,965,041 a large number of rollers must be provided in order to occlude the pump hose at at least two points. Thus, the problem of hemolysis already outlined again arises.

Furthermore, in this known roller pump a rotor with fixedly mounted rollers is necessary so that with this pump as well only one pump hose with a defined cross-section can be used.

The problem underlying the present invention is to provide a peristaltically operating roller pump which largely independently of the cross-section of the pump hose used and under changing operating conditions guarantees an occlusion of the pump hose with defined spring force and furthermore pressure pulsations in the pumped medium are substantially reduced largely independently of the number of rollers.

This problem is solved by the characterizing features of the present invention.

Because there is a gear connection between the two roller carriers in such a manner that a forced radial movement of one roller results in a corresponding follow-up movement of the other roller or rollers, it is achieved that those resiliently outwardly pressed rollers which are constrained against the spring force by bearing on the pump hose to a radially inner orbit by means of the gear connection also hold all the other rollers on precisely this orbit, irrespectively of on which radius defined by the hose used the roller in engagement at that time is running. As a result, even in the region of its lifting from the pump hose the respective roller remains on the predetermined orbit and cannot be moved to a radially outer orbit under the influence of the pressure spring. In contrast to the case with rollers mounted fixedly on the rotor, however, the radius of the circular orbit is not finally fixed; the spring elements enable the rolling circle diameter of the rotor to be adapted to the particular pump hose. Thus, pump hoses with different wall thicknesses and different diameters can be employed, the hoses always being reliably occluded but no subsequent movement of the rollers under spring force occurring.

Since in accordance with the present invention the bearing wall of the pump bed comprises in the exit region a curvature gradually increasing in radius in the direction of rotation of the roller, the lift-off movement of the roller is slower, i.e. the roller more gradually releases the hose cross-section. Such a suitable form of the exit region ensures that per angular step of the rotor the exiting roller releases an equal volume element in the hose interior so that pressure pulsations in the pumped medium are largely eliminated.

The subsidiary claims relate to further advantageous developments of the invention.

Further details, features and advantages of the invention will be apparent from the following description with the aid of the drawings, wherein.

Figure 1:
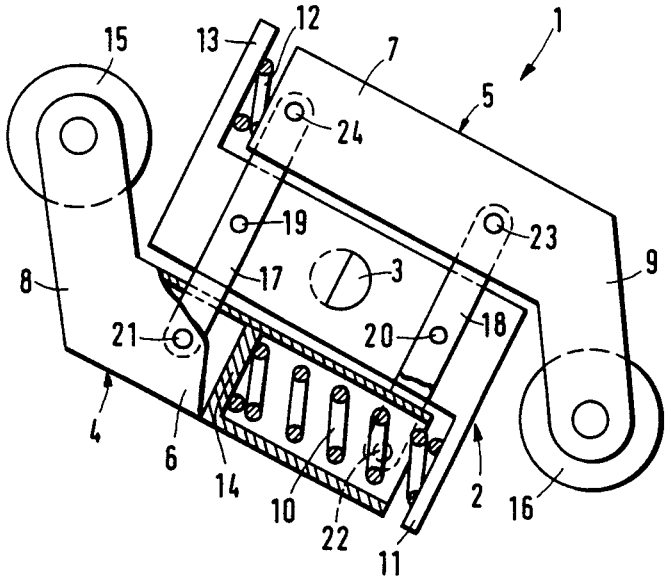
FIG. 1 is a schematic view of an embodiment of the rotor according to the invention.

A rotor designated by 1 in FIG. 1 comprises a drive member 2 which is mounted rotatably by a drive shaft 3 in a pump bed not illustrated in the drawing. The drive shaft 3 of the drive member 2 is located in the pump bed in such a manner that its axis of rotation coincides with the radius centre point of the pump bed.

Furthermore, the rotor 1 comprises 2 roller carriers 4 and 5 each formed from a guide portion 6 and 7 respectively having substantially the form of an elongated rectangle and each comprising at their narrow sides an integrally formed roller carrier leg 8 and 9 respectively angled with respect to the longitudinal axes of the guide portions.

The guide portion 6 is shown partially cut away in FIG. 1 in order to show the arrangement of a spring 10. The spring 10 bears with one end on a flange 11 which is formed on the drive member 2. For reasons of symmetry the same applies to the guide portion 7 in which likewise a spring 12 is disposed which bears on a second flange 13 which is formed on the drive member 2. The other end of the spring 10 bears on an abutment 14 which is formed in the interior of the guide portion 6. The spring 12 of the guide portion bears with its other end analogously also on an abutment which is not shown in the drawing.

In the end regions of the roller carrier legs 8 and 9 two rollers 15 and 16 are rotatably mounted so that their axes of rotation extend parallel to the axis of rotation of the drive shaft 3 and the line connecting the axes of rotation of the rollers 15 and 16 intersects the axis of rotation of the drive shaft 13.

The two roller carriers 4 and 5 are mounted on the drive member 2 via two lever rods 17 and 18 which are rotatably mounted on the drive member 2 by means of two pivot pins 19 and 20. The pivot pins 19 and 20 are disposed in the center of the longitudinal extent of the rods 17 and 18. In the region of the outer ends of the rods 17 and 18 the roller carriers 4 and 5 are also rotatably mounted. The mounting is by four further pivot pins 21, 22, 23 and 24. The two roller carriers 4 and 5 are connected to the two lever rods 17 and 18 in such a manner that the four pivot points formed by the four pivot pins 21, 22, 20 and 19 and the four pivot points formed by the four pivot pins 19, 20, 23 and 24 each represent the corner points of a rectangle or, in the displaced condition, of a parallelogram.

As a result of this parallelogram guide the two roller carriers 4 and 5 and thus the two rollers 15 and 16 due to the pressure thereon are urged outwardly by the springs 10 and 12 in the radial direction away from the drive shaft 3. Since the lever rods 17 and 18 transmit the movement of the roller carrier 4 to the second roller carrier 5 the movement of the two rollers 15 and 16 is always centrally symmetrical to the drive shaft 3. If now on rotation of the rotor 1 in the operating direction a roller, for example the roller 15, is constrained by the pump bed to move on a circular path the other roller also moves on a circular path with the same radius.

The rolling speed of a roller on a pump hose during a revolution of the rotor 1 with constant speed is likewise always constant and consequently no pressure surge in the pumped medium can occur.

In this manner the operating principle of a rotor pump with rigidly mounted rollers is achieved. However, in contrast to such rotor pumps the radius of the circular orbit is not finally fixed; the springs 10 and 11 permit the rolling circle diameter of the rotor 1 to adapt itself to the particular pump hose. Thus, hoses of different wall thickness and hoses of different diameter can be employed without damaging the hoses and with the certainty that occlusion always occurs.

However, it has been found that when a pump rotor according to the invention is combined with a conventional pump bed pulsations in the pumped medium were greatly reduced but that fluctuations in the delivery rate still occurred.

Figure 2:
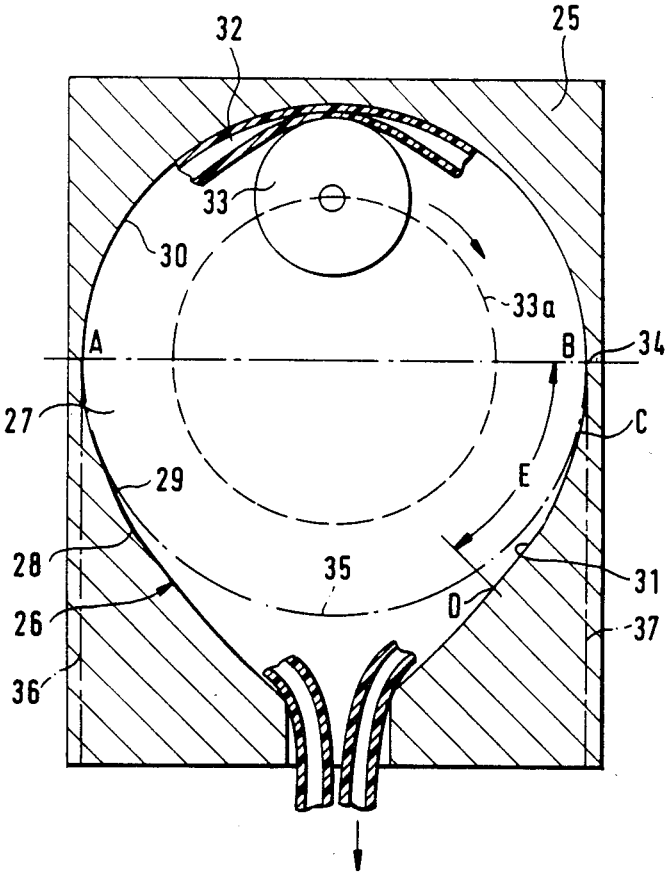
FIG. 2 shows an embodiment of the pump bed according to the invention.

This situation will be explained in more detail with reference to FIGS. 2 to 4 below:

FIG. 2 shows diagramatically an embodiment of a pump bed according to the invention which in conjunction with the pump rotor according to the invention represents a particularly advantageous combination. According to FIG. 2 a pump bed 25 comprises a trough-like depression 26 with a bottom surface 27 and a bearing wall 28 upright with respect to the bottom surface 27. The bearing wall 28 is divided into three portions: An entry region 29, a working region 30 and an exit region 31. In engagement with the bearing wall 28 is a pump hose 32 which is periodically occluded by at least one roller 33 which is mounted on a rotor not shown in the drawing. As regards the construction and arrangement of the pump hose 32 reference is made to the complete contents of the patent application with the title "Peristaltically operating roller pump" of the same applicants Ser. No. 633,798 filed July 24, 1984. The roller 33 runs on a rolling circuit 33*a* of constant radius indicated in FIG. 2 by a dashed line. As further apparent from FIG. 2 in the exit region 31 following the working region 30 after the transition point 34 the bearing wall 28 moves back from the theoretical circular periphery of the working region 30, indicated by dot-dash line 35 in FIG. 2. According to FIG. 2 the bearing wall 28 has a curvature which has a radius increasing in the direction of rotation of the roller 33. The dot-dash lines 36 and 37 show the path of the exit region in a pump bed of the type corresponding to the prior art. It is seen that the path of the exit region adjoins the working region 30 at the transition point 34 in the form of a tangent.

If the pump hose 32 illustrated in FIG. 2 and completely occluded by the roller 33 in the view shown is considered it is seen that on complete occlusion the pump hose 32 is not only cut off in cross-section but due to the engagement over a part of the periphery of the roller 33 is subjected to a volume reduction compared with an unoccluded hose. When the roller 33 is lifted from the pump hose 32 additional volume becomes available for the medium in the hose. Since the usual roller pumps have two rollers mounted symmetrically opposite each other on a rotor the pump hose 32 is always fully occluded by one roller. Since considered from the suction side the pump hose 32 is again completely sealed when it is freed on the pressure side by the roller 33, the additional volume suddenly available is occupied by the pumped medium already disposed on the pressure side outside the pumping region. Thus, at the pressure-side connection of the roller pump fluctuations of the flow rate occur, these fluctuations being the greater the more rapid the roller 33 is lifted off the pump hose 32.

Figure 3:
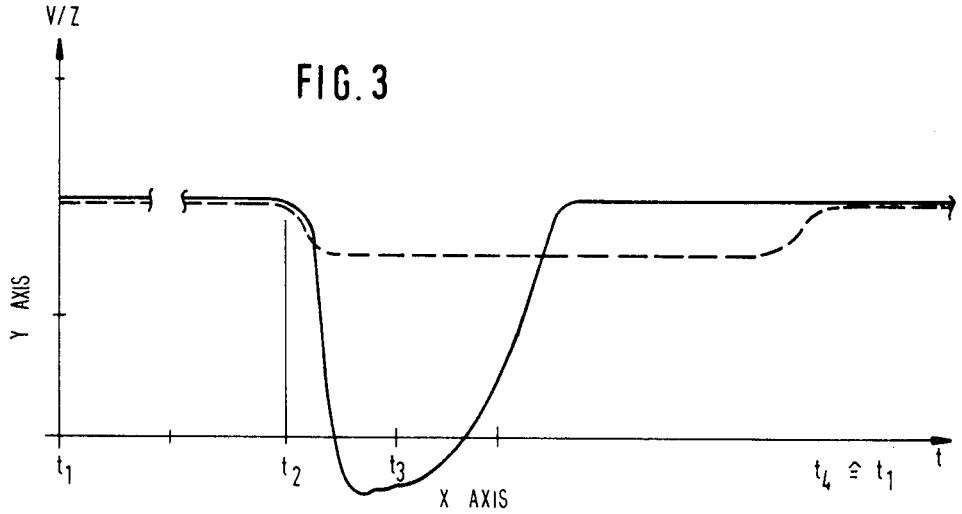
FIG. 3 is a time diagram showing the delivery behavior of a conventional roller pump and a roller pump according to the present invention.

The time diagram shown in FIG. 3 makes this relationship clearer. In the diagram the x axis is the time base and along the y axis the delivery volume per unit time is plotted. In FIG. 3 the full line represents the delivery behavior of a known roller pump and the dashed line the delivery behavior of a roller pump according to the invention.

In the region of $t_1$ to $t_2$ the delivery rate is constant because the pump hose 32 is occluded by a rotating roller. The medium disposed in the pump hose is pressed by the rotating roller 33 to the pressure-side connection. The roller comes from the inlet region 29 and passes through the arcuate working region 30 in the direction towards the exit region 31. From the instant $t_2$ from the transition point 34 onwards, the roller in the conventional roller pump lifts practically abruptly at a steep angle off the pump hose 32. The abruptly forming additional volume in the pump hose must be filled up by the medium disposed on the pressure side already outside the pump because the pump hose 32 is already again completely occluded by a roller from the suction-side connection. Consequently, at the pressure-side outlet of the roller pump a rapid decrease of the delivery rate occurs. In the most unfavorable case the volume release in the pump hose 32 may be so rapid that at the pressure-side connection of the roller pump the pumped medium comes briefly to a standstill or even flows back against the pumping direction.

From the instant $t_3$ onwards the volume released in the pump hose has been filled by the medium in the hose on the pressure side and the delivery rate again increases. From the instant $t_4$ onwards the delivery rate is in each case constant again, the process just described follows again at $t_1$ and is repeated periodically. In contrast, the behavior of a roller pump according to the invention is different. The dashed line in FIG. 3 illustrates this situation. It is seen that from the instant $t_2$ onwards analogously to the roller pump described above the amount pumped per unit time decreases; since however the lifting-off of the roller from the pump hose is extended over a long period and in particular per angular step of the rotor the same volume element is released in the interior of the hose, the decrease of the delivery rate per unit of time is not abrupt over a short period but extended over a greater period. Of essential importance in this connection is the same volume release in the hose interior per angular increment of the rotor; since the pump hose 32 is not released abruptly by the roller 33 the medium disposed on the pressure side in the pump hose 32 has the opportunity of slowly and continuously compensating the resulting volume increase in the hose interior. Also by the continuous delivery from the suction-side connection the decrease of the delivery rate per unit time at the pressure-side connection is reduced.

Thus, compared with the full line in FIG. 3 and considered over a longer period the roller pump according to the invention exhibits a reduced pulsation behavior without any pronounced peaks.

Figure 4:
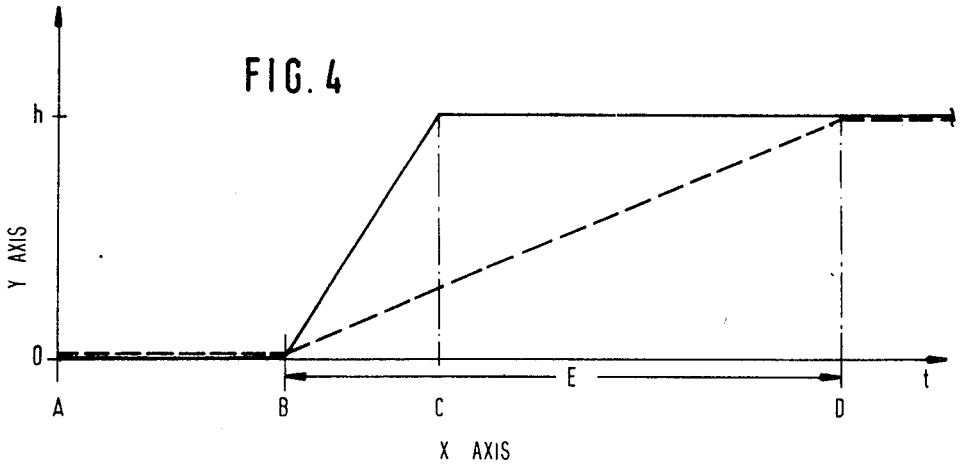
FIG. 4 is a time diagram showing the lift off behavior of a roller from the pump hose in a conventional roller pump and a roller pump according to the present invention.

In the time diagram illustrated in FIG. 4 in greatly simplified schematic manner by the full line the lift-off behavior of the roller from the pump hose in a conventional roller pump is illustrated and by the dashed line the lift-off behavior of a roller in a roller pump according to the invention. On the y axis the lift-off height of the roller with respect to the pump hose is represented. At h, the roller has completely released the pump hose. In the region from A to B, corresponding to the working region 30 of FIG. 2, the roller has the height O with respect to the pump hose, i.e. the pump hose is completely occluded by the roller. From the point B onwards the open phase of the pump hose begins and with a conventional roller pump is concluded at the point C whereas with the roller pump according to the invention it extends over a greater region up to the point D. The lift-off region B to D, denoted by E in FIG. 4, is also shown in FIG. 2.

For production and operating reasons it is advantageous for the contour of the entry region 29 to be made axis-symmetrical to the contour of the exit region 31. As a result, firstly the roller pump is suitable both for clockwise and anticlockwise running and secondly the pump hose 32 is gradually occluded by the roller 33 in exactly the same manner as it is released in the exit region. A careful handling of the pumped medium is thus ensured and in particular the hemolysis rate, i.e. the destruction of the red blood cells, is greatly reduced.

Figure 5:
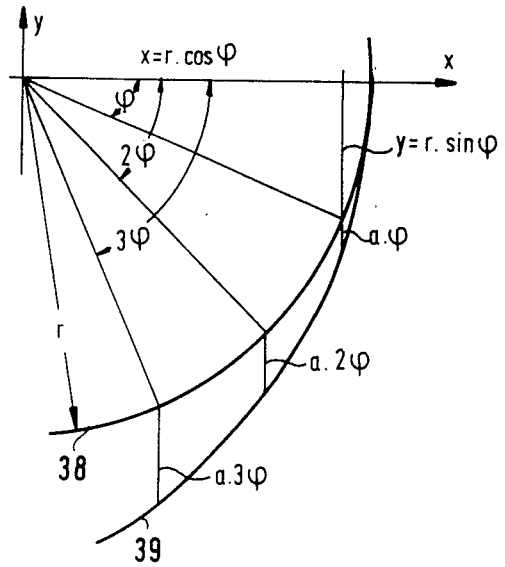
FIG. 5 shows an approximate geometric configuration of a pump bed according to the present invention.
Figure 6:
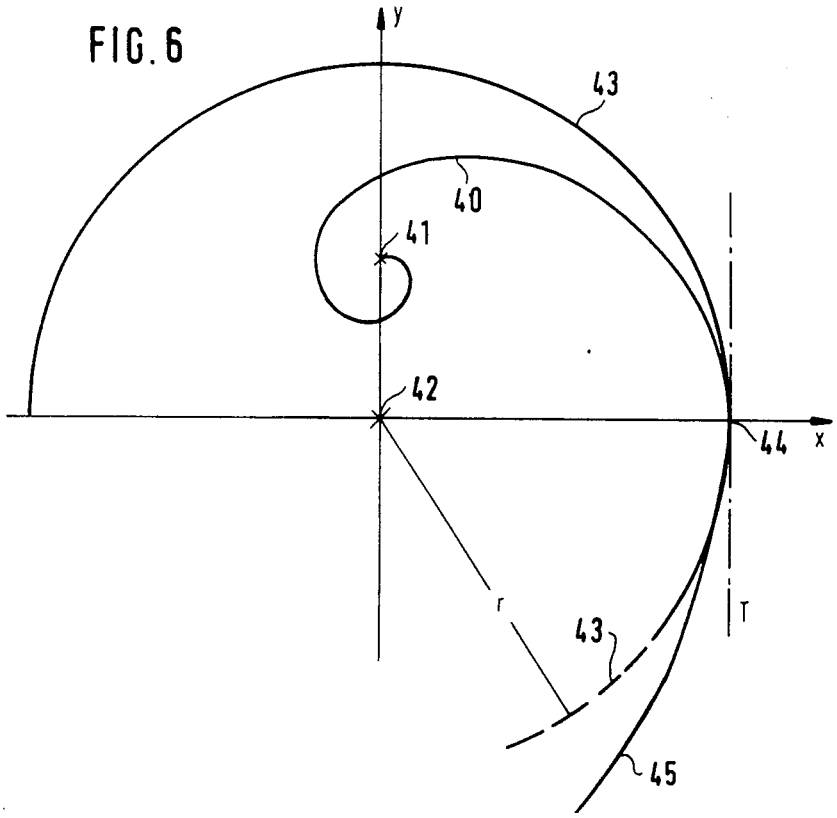
FIG. 6 shows an approximate geometric configuration of a pump bed according to the present invention.

FIGS. 5 and 6 show geometrical design possibilities with which in both cases the exit region 31 and the entry region 29 can be given approximately the desired contour.

The design possibility illustrated in FIG. 5 is that per angular step $\gamma$ of the rotor 1 to the y coordinate of a circle 38 a constant a is added. The resulting curve 39 represents a good approximation to the desired path of the exit region 31 or the entry region 29. Because of their simple geometrical relationships this design possibility is a suitable programming basis for NC machine tools.

The design possibility illustrated in FIG. 6 is that an Archimedian spiral 40 is positioned so that its center 41 is displaced from the center 42 of a circle with the radius r in the positive y direction by an amount such that both functions have a common tangent at the point 44. It is thus ensured that the contour of the exit region 31, designated in FIG. 6 by 45, following the working region 30 adjoins the end point of the working region 30 or the transition point 44 with the slope O and then progressively gradually increases.

Figure 7:
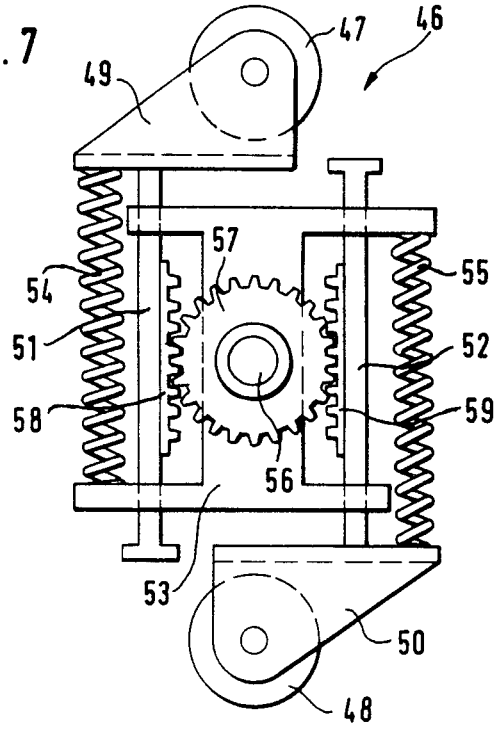
FIG. 7 is a schematic illustration of another embodiment of the rotor according to the invention.

FIG. 7 shows another embodiment of a pump rotor for the roller pump according to the invention in which the roller carriers are not subjected to a parallelogram guiding via two lever rods but to a linear guiding. A pump rotor designated by 46 in FIG. 7 has in the example two rollers 47 and 48 each rotatably mounted on a roller carrier 49 and 50. The two roller carriers 49 and 50 are each secured to a guide rod 51 and 52 respectively and these rods are in turn displaceably mounted with a two-point guide in a drive member 53. Two springs 54 and 55 subject the roller carriers 49 and 50 to a radially outwardly directed force. The mounting of the two rollers 47 and 48 in the roller carriers 49 and 50 is such that analogously to the rotor of a roller pump illustrated in FIG. 1 the axes of rotation of the rollers 47 and 48 extend parallel to the longitudinal axis of a drive shaft 56 of the drive member 53 and that the connecting line through the axes of rotation of the rollers 47 and 48 extends through the axis of rotation of the drive shaft 56. Concentrically with the drive shaft 56 a gear 57 is rotatably arranged and meshes with two racks 58 and 59. The racks 58 and 59 are each secured to the guide rods 51 and 52 respectively so that the gear 57 transmits the movement of one roller carrier to the other. Thus, in this case as well the movement of the rollers 47 and 48 is always centrally symmetrical to the axis of rotation of the drive shaft 56.

The number of rollers in this system is not restricted to two; any desired number of rollers may be disposed, the same function principle applying in every case.

Figure 8:
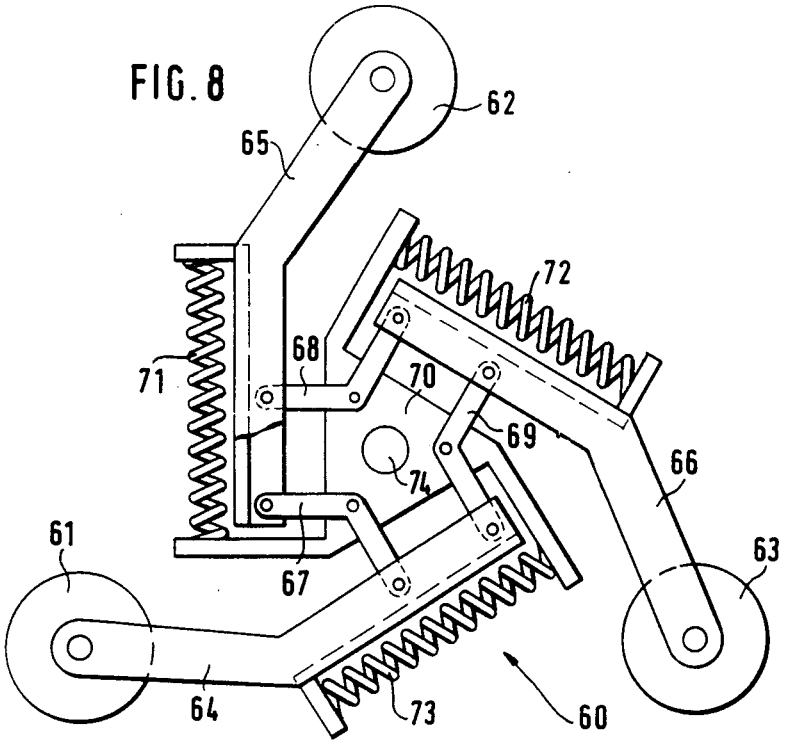
FIG. 8 is a schematic view of a third embodiment of the rotor according to the invention.

FIG. 8 shows the schematic construction of a rotor for a roller pump according to the invention which comprises three rollers and movement transmission between the rollers by means of levers. It is also possible to control the rollers by means of linear guiding as illustrated in FIG. 7, A rotor illustrated in FIG. 8 and designated by 60 comprises 3 rollers 61, 62 and 63 which are mounted rotatably on three carriers 64, 65 and 66 respectively. The mounting of the roller carriers 64, 65 and 66 is analogous to the roller pump illustrated in FIG. 1 with levers. The levers 67 to 69 are rotatably connected at their centers to a drive member 70 and in their end regions secure the roller carriers 64 to 66 in pivot pins. Three springs 71, 72 and 73 act on the roller carriers 64 to 66 with a radially outwardly directed force and as a result the rollers 61 to 63 are urged outwardly in the radial direction away from a drive shaft 74. This arrangement also ensures that the movements of the rollers 61 to 63 are always centrally symmetrical with respect to the drive axis.

As already mentioned an arrangement with four or more rollers would also be possible but with increasing roller number, as pointed out already, the hemolysis rate increases, i.e. the destruction of the red blood cells.

Summarizing, it may be concluded that the roller pump in addition to minimizing the pulsation has the advantage that it operates almost noiselessly. The typical clicking noise of hithertoknown roller pumps with resiliently mounted rollers occurring when the rollers lift off the pump hose and caused by the roller carriers striking a stop means does not occur in the roller pump according to the invention.

Firstly, the silent running is appreciated by persons who must stay often near a roller pump, for instance patients who must undergo blood purification; secondly, because in the roller pump according to the invention the roller carriers in operation do not move radially the pump is less liable to material fatigue.

We claim:

1. Peristaltically operating roller pump, comprising:

(a) a pump rotor, comprising a drive member which is rotatably drivable by means of a drive shaft of the pump, and rollers which are distributed symmetrically over the periphery of the drive member and are mounted on roller carriers which are radially outwardly loaded by springs bearing on the drive member, the roller carriers being coupled together via a connection, said connection being independent from said drive shaft which guides the roller carriers symmetrically with respect to the drive shaft, and (b) a pump bed, comprising a bottom surface disposed parallel to the rotation plane of the pump rotor;

a bearing wall extending continuously upright with respect to the bottom surface, the bearing wall comprising a working region in which the bearing wall is made arcuate and concentric with the axis of rotation of the pump rotor and in which a pump hose can be placed in order to be subjected to the action of the rollers of the pump rotor, and an exit region in which the bearing wall drops back from the circular path of the rotor, characterized in that the connection between the roller carriers converts a constrained radial movement of one roller into a corresponding follow-up movement of the other roller carrier.

2. Roller pump according to claim 1, characterized in that the bearing wall of the pump bed comprises in the exit region a curvature which is the same as the circular path of the roller and which has a radius of curvature which has a radius which is constant with respect to the circular path of the roller.

3. Roller pump according to claim 1 or 2, characterized in that the contour of the bearing wall of the exit region corresponds substantially to the contour of a spiral.

4. Roller pump of claim 1, characterized in that the exit region extends over an arc of from about 30° to about 45°.

5. Roller pump according to claim 1, characterized in that the connection comprises at least one lever rod whose opposite end regions are pivotally mounted on the roller carriers whilst the lever rod is pivotally mounted in its center region on the drive member.

6. Roller pump according to claim 1, characterized in that the connection comprises a gear which is mounted on the drive member freely rotatably independent of the drive shaft, coaxial to the axis of the drive shaft and meshes with two racks which are in connection with the roller carriers.

7. Pump rotor for peristaltically operating roller pumps having a drive member comprising a drive shaft and rollers which are distributed symmetrically over the periphery of the drive member and are mounted on roller carriers which are radially outwardly loaded by springs bearing on the drive member, the roller carriers being coupled together via a connection which guides the roller carriers symmetrically with respect to the drive shaft, said connection being independent from said drive shaft characterized in that the connection converts a constrained radial movement of one roller to a corresponding follow-up movement of the other roller carrier.

8. Pump rotor according to claim 7, characterized in that the connection comprises at least one lever rod whose opposite and regions are pivotally mounted on the roller carriers whilst the lever rod is pivotally mounted in its center region on the drive member.

9. Pump rotor according to claim 7, characterized in that the connection comprises a gear which is mounted on the drive member freely rotatably independent of the drive shaft, parallel to the axis of the drive shaft and meshes with two racks which are in connection with the roller carriers.

10. Roller pump according to claim 1, characterized in that the bearing wall of the pump bed comprises in the exit region a curvature which is the same as the circular path of the roller and which has a radius of curvature which gradually increases the direction of rotation of the roller.

11. Roller pump according to claim 10, characterized in that the contour of the bearing wall of the exit region corresponds substantially to the contour of a spiral.

* * * * *